United States Patent [19]

Dugger

[11] Patent Number: 4,913,127

[45] Date of Patent: Apr. 3, 1990

[54] FIRE RESISTANT DUCT ACCESS DOOR FOR COOKING EQUIPMENT EXHAUST SYSTEMS

[76] Inventor: David E. Dugger, 313 Woodland Trace Dr., Knoxville, Tenn. 37022

[21] Appl. No.: 326,887

[22] Filed: Mar. 21, 1989

[51] Int. Cl.[4] ..... F24C 15/20

[52] U.S. Cl. ..... 126/299 R; 126/190; 126/307 R; 49/463; 98/115.1

[58] Field of Search ..... 126/299 R, 299 D, 299 E, 126/300-303, 307 R, 312, 200, 190, 194; 98/46, 58, 115.1, 115.3; 49/463

[56] References Cited

U.S. PATENT DOCUMENTS

| | | | |
|---|---|---|---|
| 1,864,333 | 6/1932 | Aldrich | 126/190 |
| 3,376,669 | 4/1968 | Johnston | 49/463 |
| 3,563,005 | 2/1971 | Jones | 126/299 E |
| 4,324,223 | 4/1982 | Schwartz | 126/200 |

FOREIGN PATENT DOCUMENTS

| | | | |
|---|---|---|---|
| 679645 | 9/1952 | United Kingdom | 49/463 |

*Primary Examiner*—James C. Yeung

*Attorney, Agent, or Firm*—Pitts and Brittian

[57] ABSTRACT

An access door (10) for cleaning grease from duct runs (26) in exhaust systems for kitchen cooking equipment (16). The access door (10) includes a collar (32) which is mounted at a selected location in a run of duct to provide an opening (46) for accessing the interior surfaces (30) of the duct. A fireproof cover (54) is releasably secured to the collar (32) by securing devices for selectively closing the collar opening. A seal (70) is interposed between the collar the cover, proximate the juxtaposed portions to prevent fire from escaping the duct through the collar opening when the cover is mounted thereon.

12 Claims, 3 Drawing Sheets

FIRE RESISTANT DUCT ACCESS DOOR FOR COOKING EQUIPMENT EXHAUST SYSTEMS

DESCRIPTION

1. Technical Field

This invention relates to exhaust systems for kitchen cooking equipment, and more particularly concerns a fire resistant access door which can be removed for cleaning grease from duct runs in such an exhaust system.

2. Background Art

Kitchen cooking equipment, particularly in commercial establishments, generally incorporates an exhaust hood which receives smoke and grease generated during cooking operations. The exhaust hood is connected with exhaust ductwork and a blower which serves to move the cooking smoke and grease from the area proximate the cooking equipment, and exhaust such smoke and grease at a remote location. After extended periods of use, grease builds up within the runs of the exhaust ductwork. Such grease is flammable and a potential cause of fire in restaurants.

In order to reduce the possibility of igniting the grease deposited in kitchen equipment exhaust ductwork, it is desirable to remove the grease from the interior surfaces of the ducts. Such grease commonly builds up proximate horizontal duct runs or near bends in the duct runs in exhaust systems. This is partially due to the fact that heated grease is a substantially fluid medium, and flows under gravity to the horizontal runs. Of course, there will be a grease film build-up on vertical duct runs. Heretofore, it has been awkward to clean the exhaust ductwork associated with kitchen cooking equipment. Often, such cleaning operations required disassembling the exhaust ductwork system to effect proper cleaning. Such disassembly is time consuming and expensive.

Accordingly, it is an object of the present invention to provide a fire resistant access door for exhaust ductwork.

It is also an object of the present invention to provide such an access door which is releasably secured to a collar carried by a run of duct. The collar defines an opening which is selectively covered by the fire resistant access door. The access door can be readily removed to enable cleaning grease from the interior surfaces of the ductwork.

Yet another object of the invention is to provide a fire resistant cover which incorporates a thermal insulation chamber in the preferred embodiment.

It is also an object of the present invention to provide sealing means mounted proximate juxtaposed portions of said collar and said cover to prevent fire from escaping said duct through said collar opening when the cover is mounted thereon.

DISCLOSURE OF THE INVENTION

Other objects and advantages will be accomplished by the present invention which provides a fire resistant access door for cleaning grease from duct runs in exhaust systems for kitchen cooking equipment. The door includes a collar which is mounted at a selected location in a run of duct and defines an opening in the duct for cleaning grease from its interior surfaces. A fire resistant cover is releasably secured to the collar for closing the collar during operation of the kitchen cooking equipment. Securing devices serve to releasably secure the cover to the collar such that it can be readily removed for cleaning operations. A seal which is positioned proximate juxtaposed portions of the cover and collar serves to assist in preventing fire from escaping the duct through the collar opening when the cover is secured.

BEST MODE FOR CARRYING OUT THE INVENTION

Figure 1:
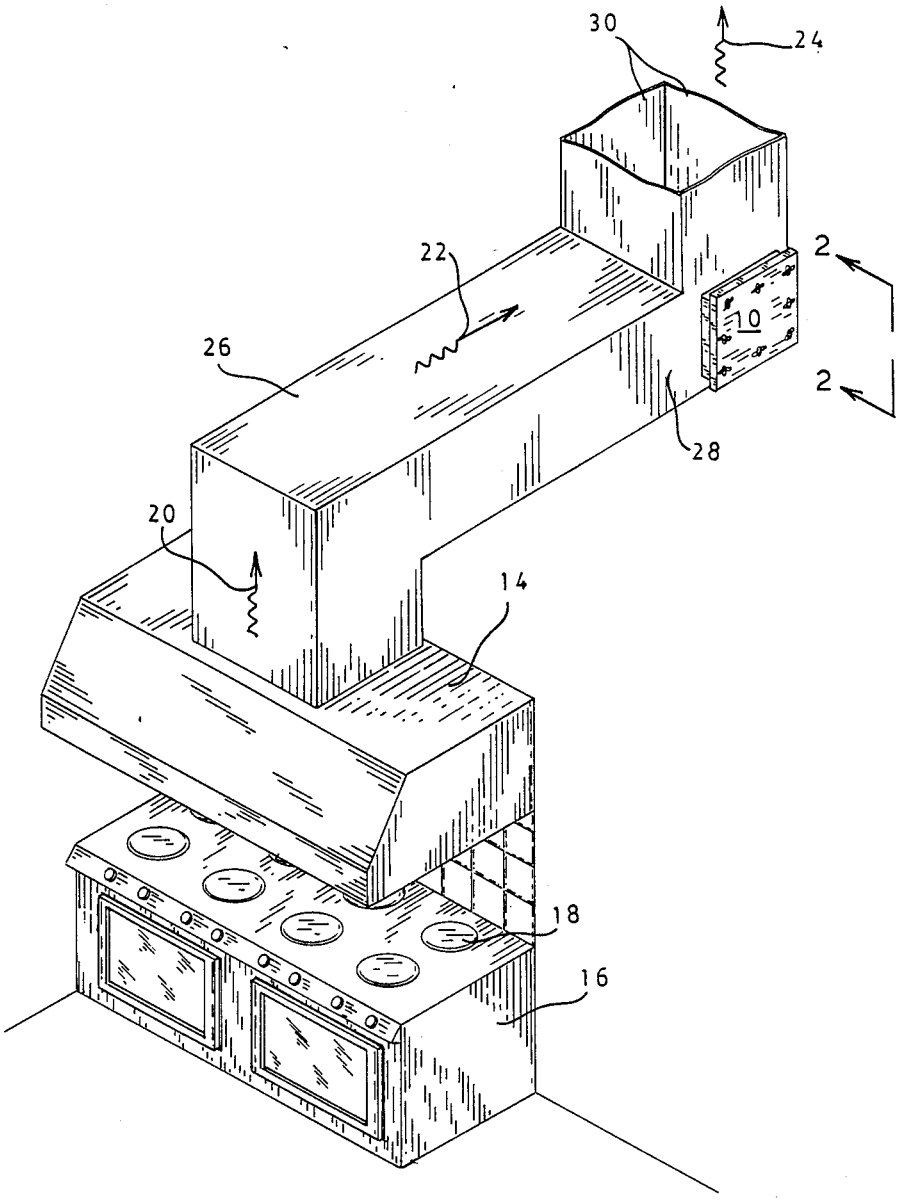
FIG. 1 illustrates kitchen cooking equipment used in connection with a conventional exhaust hood and exhaust ductwork which serves to discharge smoke and grease at a remote location. A fire resistant access door constructed in accordance with various features of the invention is depicted proximate the bend in the exhaust ductwork as shown.

A fire resistant access door constructed in accordance with various features of the present invention is generally indicated at 10 in the figures. It will be noted in FIG. 1 that the access door of the present invention is mounted in exhaust ductwork 12 which is connected to an exhaust hood 14. This exhaust hood 14 is designed to receive smoke and grease generated by cooking equipment 16 having heat sources 18 of conventional design. During the operation of cooking equipment 16, grease and smoke rise from the heat sources and are captured by the exhaust hood 14. A suitable blower (not shown) draws the smoke and grease-laden air in the direction of the arrows 20, 22 and 24 where the exhaust fumes are discharged at a remote location external to the building containing the cooking equipment.

Grease tends to build-up in horizontal duct runs such as the run 26, and near bends in the ductwork such as the location indicated at 28. Grease build-up or deposits in the duct runs creates areas of potential fire hazard. In order to reduce the fire hazard potential, it is desirable to provide means for gaining ready access to the interior surfaces 30 of the ductwork 12. To this end, an access door 10 is mounted onto the ductwork such that it can be readily removed to allow cleaning grease from the interior surfaces 30 of the ductwork, and particularly at locations proximate horizontal duct runs and near bends which are likely areas of potential fire hazard.

Figure 2:
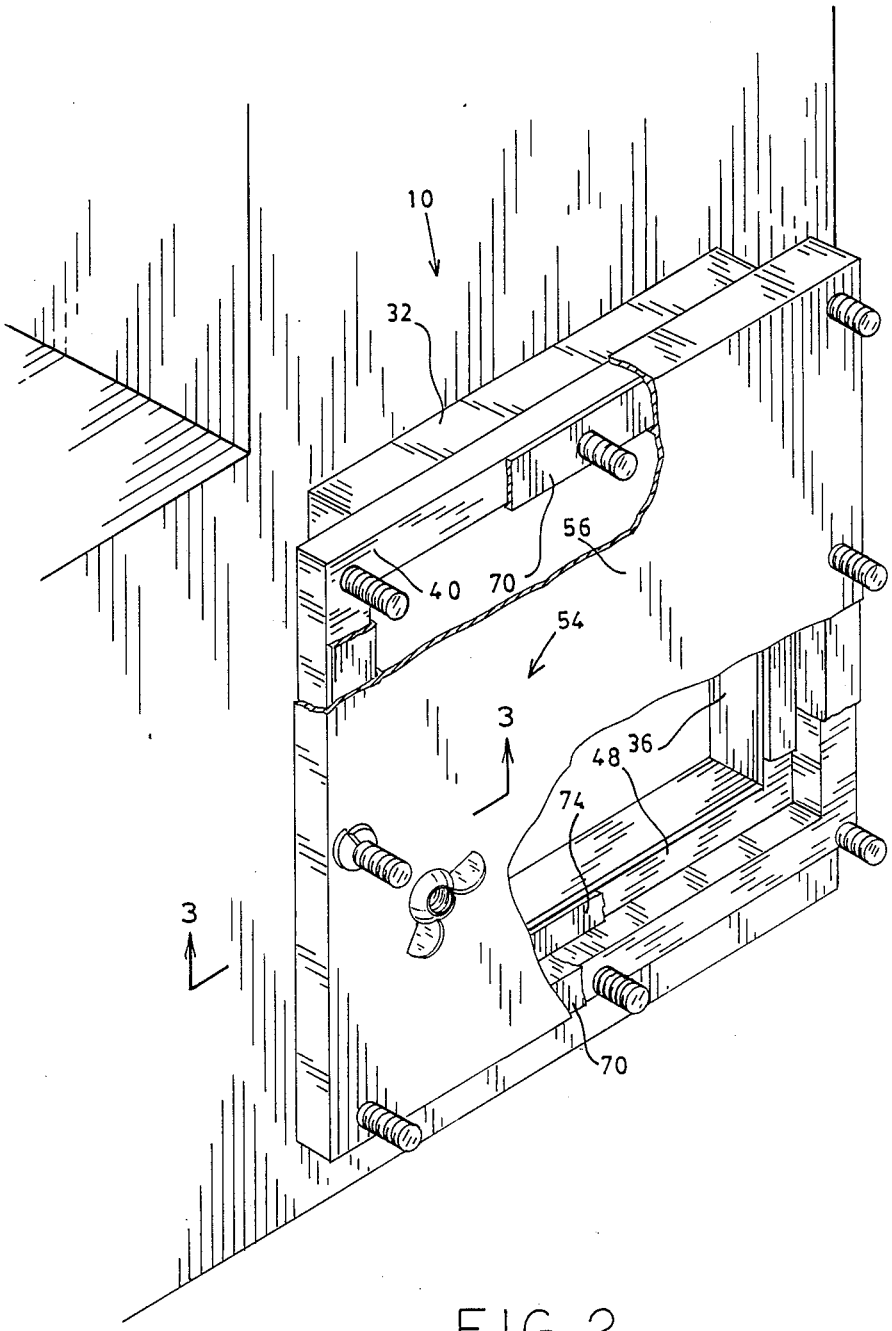
FIG. 2 illustrates a perspective view of a fire resistant access door constructed in accordance with various features of the present invention and taken along line 2—2 in FIG. 1. Portions of the door have been broken away for purposes of illustrations.
Figure 3:
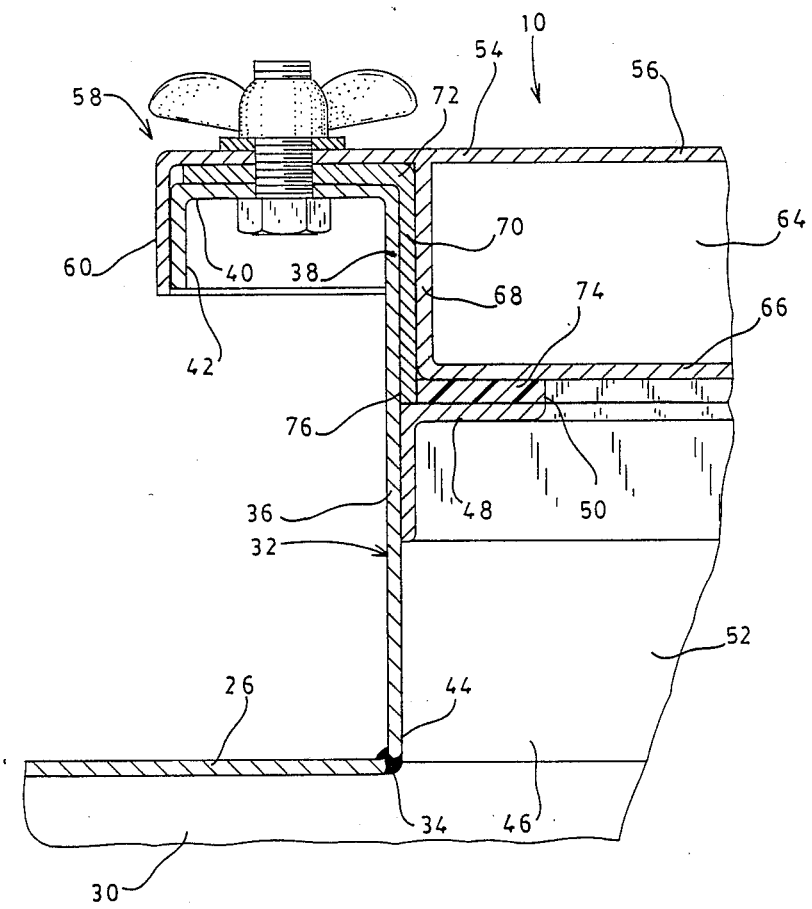
FIG. 3 illustrates a sectional side elevation view of the access door taken along line 3—3 of FIG. 2.

An access door constructed in accordance with various features of the present invention is illustrated in greater detail in FIGS. 2 and 3. Referring to these figures, it will be noted that the access door 10 includes an access collar 32 which is fixedly secured to the ductwork 26 as by welding which is indicated generally at 34 in FIG. 3. The access collar 32 is substantially rectangular in configuration and extends outwardly from the ductwork 26 as shown in FIGS. 2 and 3. More specifically, the access collar 32, as shown in cross-sectional view of FIG. 3, is fabricated from an outwardly extending member 36 which terminates at its end portion 38 in a support shoulder 40. This support shoulder 40, in turn, terminates in a depending member 42 which extends in a direction substantially parallel with the extension of member 36 in the preferred embodiment. Thus, the end portion of the outwardly extending member 36 of the access collar is substantially U-shaped as shown in the cross-sectional view of FIG. 3, and defines a support shoulder 40 which supports the access cover to be described in greater detail hereinafter. The lower portion of the collar proximate the location 44 defines an opening 46 which opens into the interior surfaces of the ductwork. It is through this opening 46 that cleaning personnel gain access to such interior surfaces of the ductwork for removal of grease.

It will also be noted in FIG. 3 that a seal support 48 is mounted onto the access collar 32, and more specifically secured to the outwardly extending member 36 of the access collar. This seal support 48 in the illustrated embodiment comprises an angle frame which defines a seal supporting surface 50 which extends into the opening 52 defined by the access collar 32. Thus, it will be noted from FIGS. 2 and 3 that the access collar 32 serves as an extension collar which extends outwardly from the ductwork 28. This extension occurs in a direction substantially perpendicular to the surface of the ductwork in the illustrated embodiment.

The access collar serves to receive an access cover generally indicated at 54. This access cover 54 is dimensioned for covering the opening 52 in the access collar 32. More specifically, the access cover is fabricated from a suitable fire proof material such as iron, steel or the like. The access cover depicted in FIG. 3 includes a substantially planar panel 56 which terminates at its end portion or perimeter 58 in a downwardly depending member 60 in the illustrated embodiment. This downwardly depending member is proportioned for being juxtaposed to the downwardly depending member 42 of the access collar 32. Suitable bores are defined in the perimeter of the panel 56 and the support shoulder 40 for receiving a bolt therethrough. This bolt and operatively associated wing-nut serves to secure the access cover 54 to the support shoulder 40 of the access collar. It will be noted in FIG. 2 that a plurality of bolts and wing-nuts are mounted about the perimeter of the access door to secure the access cover to the access collar in a manner shown in greater detail in FIG. 3.

In accordance with another feature of the present invention, the access cover includes a thermally insulating chamber 64. This chamber is defined by the access cover panel 56 which, is mounted at a spaced location from panel 66. The perimeter of panel 66 is joined with panel 56 as shown in FIG. 3 by cross panels 68, thus completing the definition of the chamber 64. This chamber 64 contains air and assists in thermally insulating the access door cover 54 in the event of fire breakout.

It will also be noted in FIG. 3 that the cross panel 68 is positioned on the panel 56 in a downwardly depending fashion at a location which is spaced from the outwardly extending member 36 of the access collar 32 when the access cover 54 is mounted onto the access collar.

Seal means are generally indicated at 70 in FIG. 3. The illustrated seal means is designed to assist in preventing fire from escaping the ductwork through the collar opening when the cover is mounted thereon. Moreover, the illustrated seal means further serves in the preferred embodiment to assist in preventing grease from escaping the confines of the access door, especially when it is heated and in a substantially fluid state. More specifically, in the embodiment depicted in FIG. 3, a fire resistant gasket indicated at 72 is interposed between the support shoulder 40 and outwardly extending member 36 of the access collar 32, and the perimeter 58 and cross panel 68 of the access cover 54. This fire resistant gasket assumes an L-shaped geometry as indicated in FIG. 3 and assists in preventing fire from escaping the confines of the access cover 54 when it is releasably secured to the access collar by the depicted bolts and operatively associated wing-nuts. A suitable air seal 74 is carried by the seal support 48. This air seal provides a means for preventing grease from escaping the confines of the access collar when the access cover is mounted thereon. It will be noted that the illustrated seal 50 is substantially rectangular in configuration and extends around the perimeter of the access collar in a manner coextensive with the seal support 48. When the access cover 54 is mounted onto the access collar 32, the seal 48 is interposed between the perimeter of the panel 66 of the access cover 54 and the seal support 48. Thus, it will be noted in FIG. 3 that the entire sealing means 70 comprises an L-shaped gasket 72 and a further seal 74. These two seals abutt at the location generally located at 76 in the preferred embodiment to form an overall and substantially continuous length of sealing means which is Z-shaped in the illustrated embodiment. The overall seal means thus, assist in preventing grease from escaping the confines of the access collar when the access cover is mounted, and further assist in resisting the spread of fire which may be occasioned in the event grease inside the exhaust ductwork ignites.

From the foregoing detailed description, it will be recognized by those skilled in the art that an access door for cooking equipment exhaust systems has been provided which assists in allowing cleaning operations to be conducted on the interior surfaces of the exhaust system ductwork. The access door is designed such that it can be readily removed for cleaning purposes and returned to the ductwork for closing the ductwork against the spread of fire after the cleaning operations. The access door is fire resistant and incorporates a thermally insulating chamber in one embodiment which further assists in preventing the spread of fire. Suitable sealing devices are interposed between the access collar and the access cover to assist in containing any fire which may be generated within the ducting system.

While a preferred embodiment has been shown and described, it will be understood that there is no intent to limit the invention to such a disclosure, but rather it is intended to cover all modifications and alternate constructions falling within the spirit and scope of the invention as defined in the appended claims.

I claim:

1. An access door to assist in cleaning grease from duct runs in exhaust systems for kitchen cooking equipment, comprising:

a collar mounted at a selected location in a run of duct to provide an opening in said duct for cleaning grease from its interior surfaces;

a fire proof cover releasably secured to said collar for closing said collar opening;

securing means for releasably securing said cover to said collar; and high temperature seal means especially fabricated to be impervious to the temperature and effects of burning grease, mounted between said collar and said cover to assist in preventing flames and said grease from escaping said duct through said collar opening when said cover is mounted thereon.

2. The access door of claim 1 wherein said collar extends outwardly from said duct, and includes a seal support which assists in carrying said high temperature seal means at a location such that a portion of said high temperature seal means is interposed between said access cover and said seal support upon mounting said cover on said collar.

3. The access door of claim 2 wherein said access cover includes a permanently formed thermally insulating air chamber substantially coextensive with the collar opening for reducing the transmission of heat when said access cover is mounted on said collar.

4. The access door of claim 1 wherein said high temperature seal means is interposed between said collar and said cover to assist in preventing the escape of said flames from said access door when said access cover is mounted on said collar.

5. An access door to provide access to the interior walls of air handling ductwork used in kitchen cooking equipment, comprising:

a collar mounted on a selected location in a section of said ductwork to surround a perforation made in said section of ductwork;

a flameproof cover releasably secured to said collar for closing said collar opening;

securing means for releasably securing said cover to said collar; and high temperature seal means especially fabricated to be impervious to the temperature and effects of burning grease, mounted between said collar and said cover to assist in preventing flames and said grease from escaping said duct through said collar opening when said cover is mounted thereon.

6. The access door of claim 5 wherein said collar extends outwardly from said duct, and includes a seal support which assists in carrying said high temperature seal means at a location such that a portion of said high temperature seal means is interposed between said access cover and said seal support upon mounting said cover on said collar.

7. The access door of claim 6 wherein said access cover includes a permanently formed thermally insulating air chamber substantially coextensive with the collar opening for reducing the transmission of heat when said access cover is mounted on said collar.

8. The access door of claim 5 wherein said high temperature seal means is interposed between said collar and said cover to assist in preventing the escape of said flames and said grease from said access door when said access cover is mounted on said collar.

9. The access door of claim 5 wherein said collar is fixedly secured to said section of ductwork by welding.

10. The access door of claim 6 wherein said collar is fixedly secured to said section of ductwork by welding.

11. The access door of claim 5 wherein said collar is removably secured to said section of ductwork by bolts therethrough secured by restraining nuts.

12. The access door of claim 6 wherein said collar is removably secured to said section of ductwork by bolts therethrough secured by restraining nuts.

* * * * *